US009926901B2

(12) United States Patent
Burrahm et al.

(10) Patent No.: US 9,926,901 B2
(45) Date of Patent: Mar. 27, 2018

(54) HYDRAULIC STARTER AND PRE-LUBRICATION SYSTEM FOR AN INTERNAL COMBUSTION ENGINE

(71) Applicant: Southwest Research Institute, San Antonio, TX (US)

(72) Inventors: Robert W. Burrahm, San Antonio, TX (US); Glenn R. Wendel, Pipe Creek, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 158 days.

(21) Appl. No.: 15/156,748

(22) Filed: May 17, 2016

(65) Prior Publication Data

US 2017/0335815 A1 Nov. 23, 2017

(51) Int. Cl.

| | |
|---|---|
| ***F01M 1/00*** | (2006.01) |
| ***F02N 11/00*** | (2006.01) |
| ***F02N 9/04*** | (2006.01) |
| ***F01M 1/02*** | (2006.01) |
| ***F01M 1/12*** | (2006.01) |
| ***F01M 1/16*** | (2006.01) |
| ***F01M 1/20*** | (2006.01) |

(52) U.S. Cl.

CPC ..... *F02N 11/003* (2013.01); *F01M 1/02* (2013.01); *F01M 1/12* (2013.01); *F01M 1/16* (2013.01); *F01M 1/20* (2013.01); *F02N 9/04* (2013.01)

(58) Field of Classification Search

CPC .... F01M 1/04; F01M 1/16; F01M 2011/0025; F01M 2011/033; F01M 5/00; F01M 2001/083; F01M 2011/022

USPC ..... 123/196 R, 196 CP, 196 AB, 196 M, 123/41.33

See application file for complete search history.

(56) References Cited

U.S. PATENT DOCUMENTS

| | | | | |
|---|---|---|---|---|
| 2014/0165947 | A1 | 6/2014 | Krittian et al. | |
| 2017/0022881 | A1* | 1/2017 | Matsumoto | F01P 7/16 |
| 2017/0356315 | A1* | 12/2017 | Miyasaka | F01M 11/0004 |

* cited by examiner

*Primary Examiner* — John Kwon
(74) *Attorney, Agent, or Firm* — Grossman, Tucker et al.

(57) ABSTRACT

An internal combustion engine oil utilization system, comprising one or more oil pumps to receive and discharge engine oil including an engine oil circulation loop comprising a first flow path and a second flow path. The first flow path receives at least a portion of the oil discharged from the one or more oil pumps and utilizes the oil to lubricate the engine during running operation of the engine. The second flow path receives at least a portion of the oil discharged from the one or more oil pumps and accumulates the oil to start the engine and/or to lubricate the engine during at least one of a pre-starting operation and a starting operation of the engine.

22 Claims, 3 Drawing Sheets

HYDRAULIC STARTER AND PRE-LUBRICATION SYSTEM FOR AN INTERNAL COMBUSTION ENGINE

FIELD

Figure 1:
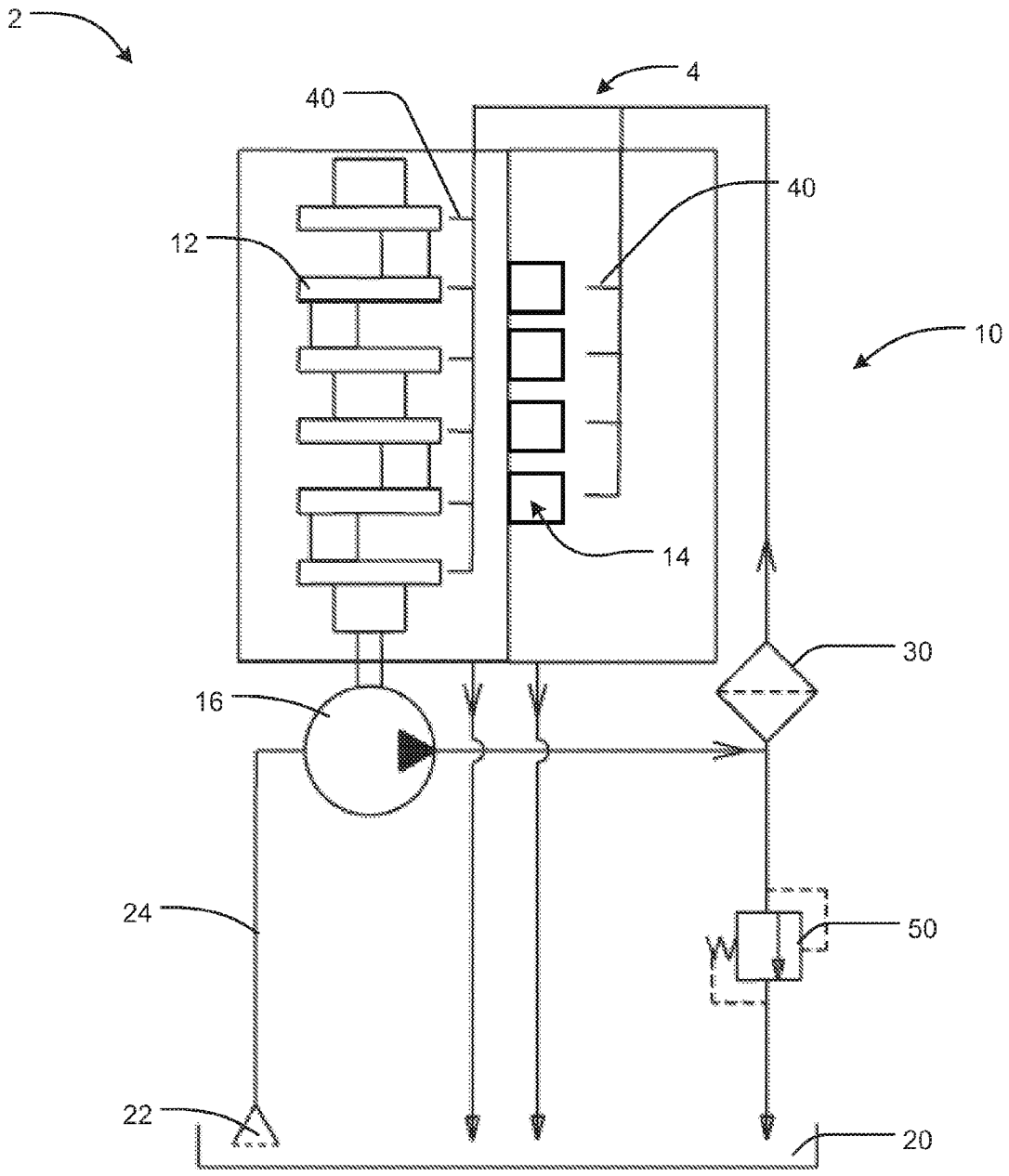
FIG. 1 (prior art)

The present disclosure relates generally to internal combustion engines, and more particularly to engine oil utilization systems which use the engine's oil to start the engine with a hydraulic starter, as well as provide lubrication to internal components of the engine during at least one of a pre-starting and a starting operation of the engine.

BACKGROUND

Many hybrid vehicles, which make use of both an electric motor and an internal combustion engine for propulsion, include a start-stop system which automatically stops the internal combustion engine when there is a low power demand, thereby increasing fuel economy and reducing emissions. The start-stop system then restarts the internal combustion engine when power demand is increased and more power is required.

More particularly, a typical start/stop system employs controls that turn off the internal combustion engine when there is little or no power demand, such as during idle conditions and during vehicle braking and coasting situations. The internal combustion engine will then be commanded to start up again as soon as more power is required.

Start/stop strategies place a much higher durability burden on the traditional electric starter system, requiring a much more robust starter, alternator and battery. Some vehicle configurations include the addition of a belt driven starter generator. Another option is to integrate a starter generator on the flywheel. However, these strategies are at additional cost. Another aspect of employing engine start/stop strategies is the potential for increased engine wear, due to the more frequent starts and the lack of lubrication until the engine oil pump has built up suitable oil pressure.

Ordinarily an electrically driven starter motor is used to start the internal combustion engine. An alternative to using electric power for starting the engine is to use hydraulic power. The use of a hydraulic starter motor to start an engine is known, particularly to start large internal combustion engines (e.g. heavy road construction equipment) instead of an electrically driven starter.

SUMMARY

The present disclosure provides vehicle systems and methods which make use of hydraulic energy stored in an accumulator to start an internal combustion engine, particularly with the accumulator being pressurized with the internal combustion engine's oil using excess engine oil pump flow that would have normally been wasted energy. The present disclosure also provides a pre-lubrication system using the oil stored in the accumulator to lubricate the internal combustion engine during at least one of a pre-starting operation and a starting operation of the engine. Such systems and methods may be utilized to provide repeated starting of the engine within a plurality of start-stop cycles.

In certain embodiments, an internal combustion engine oil utilization system may be provided, with the system comprising one or more oil pumps to receive and discharge engine oil; an engine oil circulation loop comprising a first flow path and a second flow path; the first flow path to receive at least a portion of the oil discharged from the one or more oil pumps and utilize the oil to lubricate the engine during running operation of the engine; and the second flow path to receive at least a portion of the oil discharged from the one or more oil pumps and accumulate the oil to start the engine and/or to lubricate the engine during at least one of a pre-starting operation and a starting operation of the engine.

In certain embodiments, a method of engine oil utilization for an internal combustion engine may be provided, with the method comprising providing one or more oil pumps to receive and discharge oil; providing an engine oil circulation loop comprising a first flow path and a second flow path; the first flow path to receive at least a portion of the oil discharged from the one or more oil pumps and utilize the oil to lubricate the engine during running operation of the engine; and the second flow path to receive at least a portion of the oil discharged from the one or more oil pumps and accumulate the oil to start the engine and/or to lubricate the engine during at least one of a pre-starting operation and a starting operation of the engine; starting the engine with a hydraulic starter motor, wherein the hydraulic starter motor is driven with engine oil stored in a hydraulic accumulator of the second flow path; operating the engine; while operating the engine, providing oil to the first flow path from the one or more oil pumps and lubricating the engine with at least a portion of the oil provided in the first flow path; and while operating the engine, providing oil in the second flow path from the one or more oil pumps and storing at least a portion of the oil in the hydraulic accumulator.

FIGURES

Figure 2:
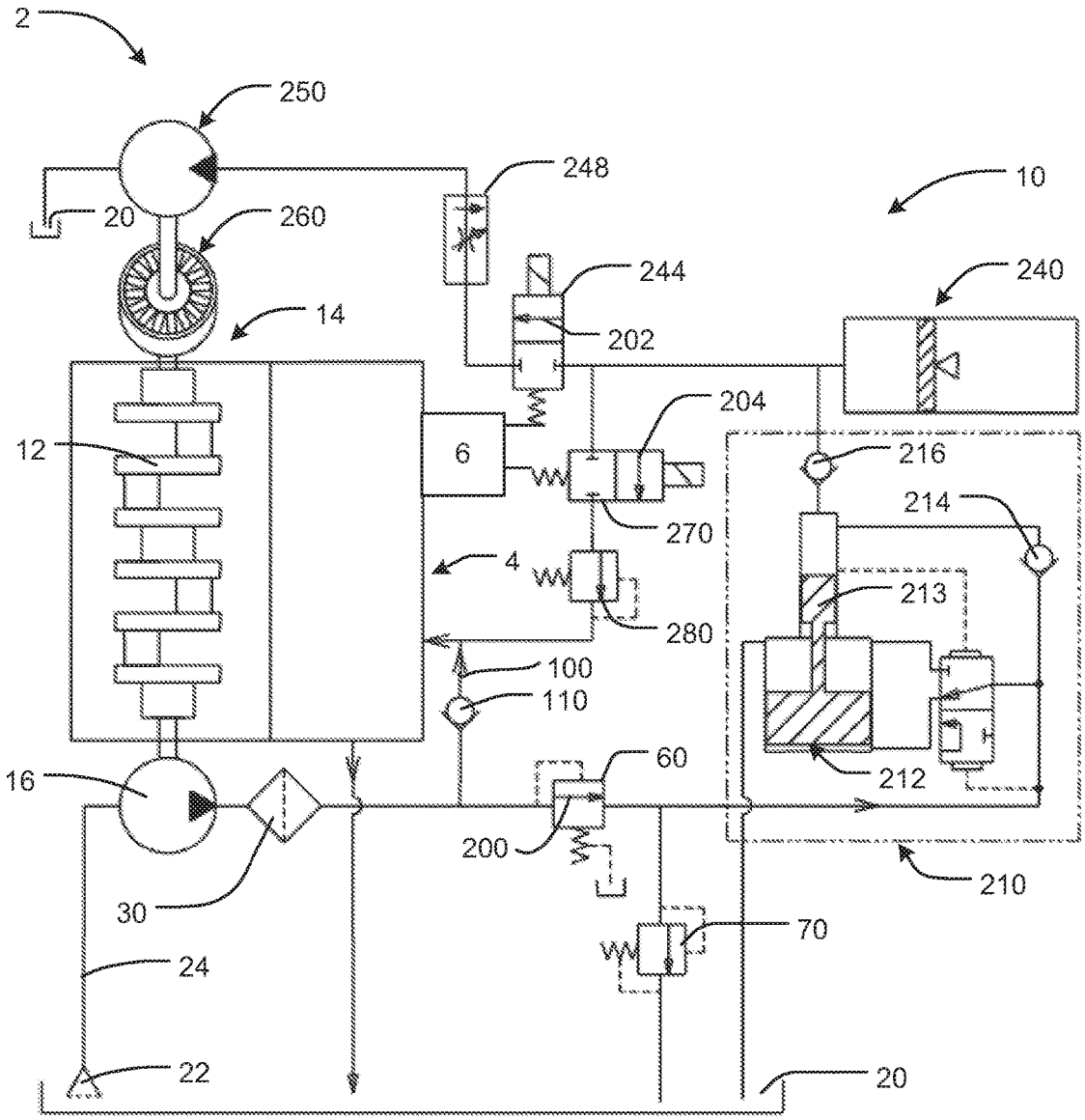
Figure 3:
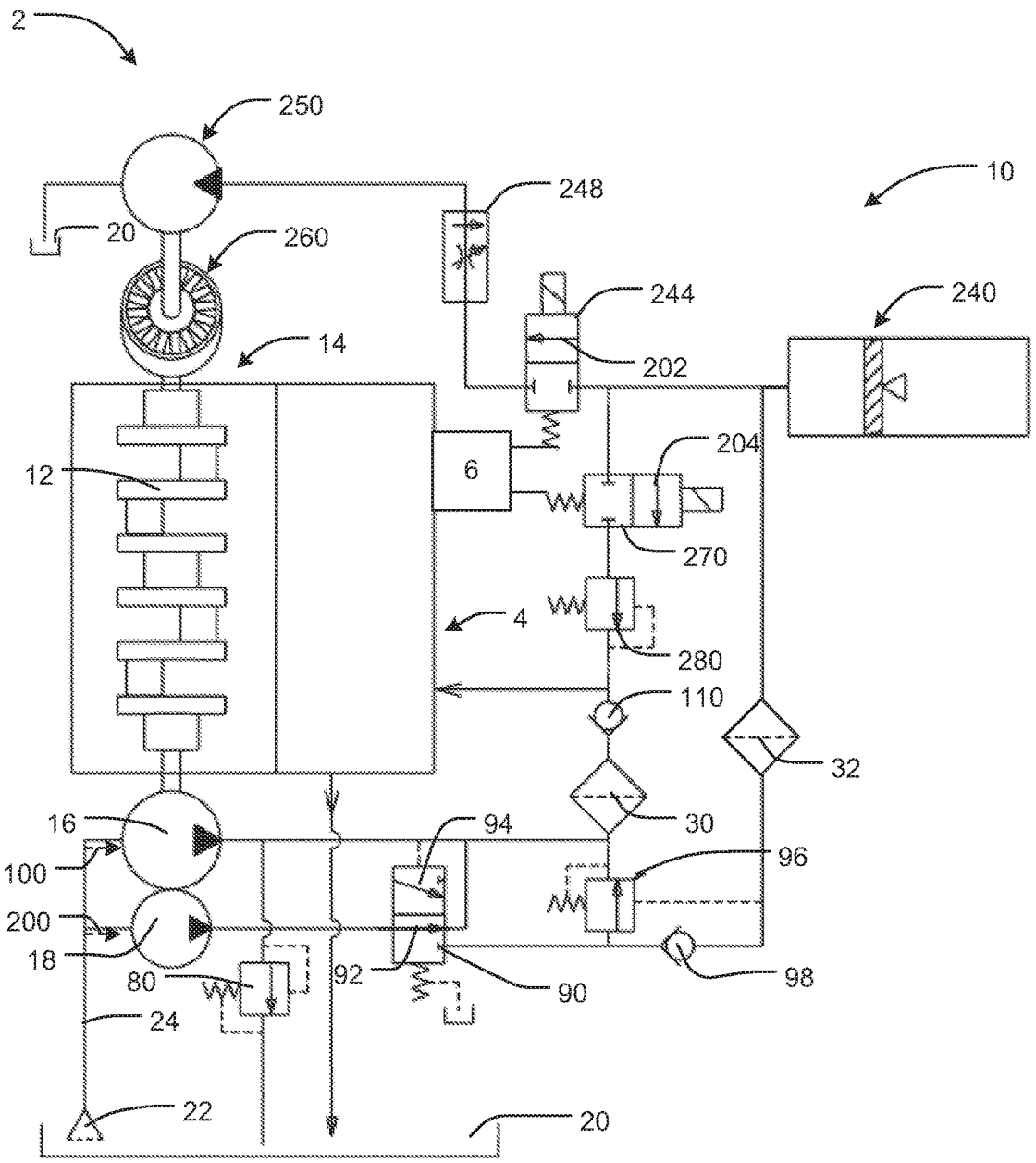

The above-mentioned and other features of this disclosure, and the manner of attaining them, will become more apparent and better understood by reference to the following description of embodiments described herein taken in conjunction with the accompanying drawings, wherein:

FIG. 1 is a schematic of an internal combustion engine oil utilization system known in the prior art; and FIG. 2 is a schematic of an internal combustion engine oil utilization system according to a first embodiment of the present disclosure; and FIG. 3 is a schematic of an internal combustion engine oil utilization system according to a second embodiment of the present disclosure.

DETAILED DESCRIPTION

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

The present disclosure provides vehicle systems and methods which utilize hydraulic energy stored, e.g. hydraulic energy stored in an accumulator, to start an internal combustion engine, particularly to rotate a flywheel to rotate a crankshaft of the engine. Such accumulator may be pressurized with the internal combustion engine's oil using excess engine oil pump flow that would have normally been wasted energy. The present disclosure also provides a pre-lubrication system using the engine oil stored in the accumulator to lubricate the internal combustion engine during at least one of a pre-starting operation and a starting operation of the engine.

Accordingly, the present disclosure makes use of a hydraulic motor to start, through one or a plurality of start-stop cycles, an internal combustion engine using pressurized engine oil stored at a selected location, such as the accumulator. In addition, the stored engine oil may be released into the engine lubrication system just prior to and/or during cranking of the internal combustion engine to pre-lubricate the engine components and supply pressure for actuating variable cam systems. To increase the energy density of the system, the engine oil may be pressurized by a hydraulic intensifier and stored in a relatively high pressure accumulator to reduce the required size of the hydraulic starter motor and the accumulator.

An internal combustion engine's oil may be pumped with an engine oil pump, such as a positive (fixed) displacement gear pump. When there is excess pressure in the system during operation of the engine, a portion of the oil flow from the oil pump may flow through a pressure relief valve and be directed back to the oil sump of the engine, in which case the energy (pressure) on the oil is lost. However, with the present disclosure, rather than all of excess oil pressure forcing a portion of the oil flow from the oil pump to flow through a pressure relief valve back to the sump, some of the oil ordinarily lost to relieve excess oil pressure may be fed into a hydraulic (pressure) intensifier. The hydraulic intensifier, which may be a piston-type intensifier, may be used to increase the oil pressure to at least about 1,000 psi. More particularly, the oil pressure may be increased in a range of 1,000-5,000 psi, and more particularly 2,000-3,000 psi. The oil may then be fed into a relatively small (e.g. 1-2 liters) hydraulic accumulator to charge the accumulator. The hydraulic accumulator may be coupled to a downstream hydraulic starter motor to start the internal combustion engine. Alternatively, the hydraulic intensifier may be eliminated, and oil under pressure of the oil pump may be provided directly to the hydraulic accumulator.

The hydraulic starter motor may be mechanically coupled to the crankshaft of the engine by a belt, or the hydraulic starter motor could be integrated into the engine and directly drive the crankshaft or the hydraulic starter motor may be integrated into the electric starter. A solenoid valve may be actuated to release high pressure hydraulic fluid from the hydraulic accumulator to the hydraulic starter motor to start the engine. Once the engine is started, the solenoid valve closes, thus stopping hydraulic oil flow to the hydraulic starter motor. The hydraulic starter motor may be coupled to an overrunning clutch, so that the drag would be minimized during normal engine operation. An electric starter may also be maintained as a backup for starting, or for cold starting, which may require more cranking time.

Referring now to the figures, FIG. 1 shows a schematic of an internal combustion engine oil utilization system including an engine oil circulation loop 10 for an internal combustion engine 2 as known in the art. As shown, the internal combustion engine crankshaft 12 drives an oil pump 16, which may be a positive (fixed) displacement pump. The oil pump 16 may be driven by a continuous (closed loop) belt used to drive one or more peripheral devices of the internal combustion engine 2. The belt may be a serpentine belt which drives a plurality of peripheral devices in addition to the oil pump, including the alternator, power steering pump, water pump and air conditioning compressor. In still other embodiments, the oil pump may be electrically driven.

The oil pump 16 receives (draws) engine oil from the engine sump 20 (which may be provided by an oil pan) through an oil strainer 22 (which may be a mesh suction filter) and a pick-up conduit 24. The oil strainer 22 collects and filters oil from the engine sump 20 due to the negative pressure (suction) created by the oil pump 16.

After being discharged from oil pump 16, the oil flows within a conduit to an oil filter 30, which removes dirt and other particulate contaminates from the oil. A pressure control (relief) valve 50 intersects this flow path to allow a portion of the pressurized oil flow to be diverted back to the sump 20 in the event the oil pressure exceeds a predetermined minimum pressure setting of the pressure relief valve 50, while the remainder of the oil flow continues to flow within the engine lubrication circuit to lubricate the engine 2. After flowing through the oil filter 30, the oil may flow within the oil gallery 4 of the engine oil lubrication loop 10, which directs the flow of oil to various locations of the engine 2. For example, the oil gallery 4 may include oil outlet (distribution) ports 40 which provide oil to the crankshaft 12, or other engine components 14, which may include bearings, cylinder walls, pistons, rings and valve train. The outlet ports 40 may include oil jets to spray oil onto the various components 14. Thereafter, the oil may flow, particularly by gravity, back to the sump 20 to complete the engine circulation loop 10.

Referring now to FIG. 2, there is shown a schematic of an internal combustion engine oil utilization system according to a first embodiment of the present disclosure. After the engine oil is discharged from oil pump 16 and oil filter 30, the engine oil circulation loop 10 segments into a first flow path 100 and a second flow path 200, as indicated by the corresponding arrows.

The first flow path 100 is arranged to receive at least a portion of the oil discharged from the oil pump 16 and to direct the filtered oil to oil gallery 4 to lubricate the internal components 14 of the engine 2 including the crankshaft 12, during running operation of the engine 2. As such, after passing through a one-way check valve 110 (e.g. ball check valve), oil in the first flow path 100 flows within conduits within the engine 2 at a pressure in a range of 25-60 psi. to oil outlet (distribution) ports 40 (as shown in FIG. 1) which provide oil to the crankshaft 12, or other engine components 14, which may include bearings, cylinder walls, pistons, rings and valve train. Thereafter, the oil handled by the first flow path 100 may flow, particularly by gravity, back to the sump 20.

The second flow path 200 is arranged to receive a portion of the oil discharged from the oil pump 16 and direct the oil to start the engine 2 and/or to lubricate the engine 2 during at least one of a pre-starting operation and a starting operation of the engine 2.

The second flow path 200 is arranged to receive a portion of the oil discharged from the oil pump 16 when oil pressure of the oil in the first flow path 100 exceeds a predetermined minimum oil pressure. Preferably, this pressure may be selected to be the desired pressure for engine operation in the range of 20 psi. to 100 psi. or any increment therein such as 40 psi. to 70 psi. For purposes of this discussion we shall assume 60 psi.

More particularly, as shown, the engine oil circulation loop 10 includes a diverter valve 60, and the second flow path 200 is arranged to receive a portion of the oil discharged from the oil pump 16 when oil pressure of the oil in the first flow path 100 exceeds a predetermined minimum oil pressure of the diverter valve 60. The diverter valve 60 may be configured to open the second flow path 200 when the oil pressure in the first flow path 100 exceeds, e.g., 60 psi.

While diverter valve 60 may be particularly configured to operate mechanically, diverter valve may also be configured to open based on an input signal received from a control module 6, such as after the control module 6 receives an input signal indicative of the oil pressure in the first flow path 100 being greater than desired. In the event the control module 6 fails to send a proper signal to open diverter valve 60, the diverter valve 60 may be configured to mechanically open to return excess oil to the sump 20.

Downstream of diverter valve 60, the second flow path 200 includes a hydraulic pressure intensifier 210 arranged to increase pressure of the oil received by the second flow path 200. More preferably, the hydraulic pressure intensifier may be arranged to increase pressure of the oil received by the second flow path to a pressure of at least 1000 psi, or in a range of 1,000-5,000 psi., and more particularly in a range of 2,000-3,000 psi. In that context, the pressure intensifier is configured to provide sufficient pressure to start the engine, as disclosed herein.

The hydraulic pressure intensifier shown in FIG. 2 is a linear intensifier that uses a dual area piston 212, but other types are available in the art. The relatively small diameter end 213 of piston 212 acts like a reciprocating pump, drawing in low pressure oil through a one-way check valve 214 on the suction stroke and discharging the oil through another one-way check valve 216 to a hydraulic accumulator 240 downstream of the hydraulic pressure intensifier 210. The area ratio of the two intensifier pistons defines the nominal amplification of the pressure between the outlet and the inlet of the intensifier. The pressure state within the hydraulic accumulator 240 determines the pressure state at the intensifier inlet in proportion to the intensifier area ratio. As the intensifier piston reaches the end of its stroke, a cycling valve is triggered to shuttle and cause the piston to retract to its starting position to repeat the cycle.

The hydraulic accumulator 240 arranged to receive, store and discharge oil pressurized and discharged by the hydraulic pressure intensifier 210. When the hydraulic accumulator 240 is completely filled, pressure relief valve 70 in flow path 200 may operate to pass excess flow to the sump 20. Also, in the event the hydraulic accumulator 240 is completely filled with oil such that it cannot be further filled with oil from hydraulic pressure intensifier 210, and the first diverter valve 60 opens the second flow path 200 to receive more oil, pressure relief valve 70 downstream of the diverter valve 60 and upstream of the hydraulic pressure intensifier 210 may be opened to return excess oil to the sump 20.

Downstream of the hydraulic accumulator 240, the second flow path 200 comprises a second flow path first (starter) branch 202 and a second flow path second (pre-lubrication) branch 204. The second flow path first (starter) branch 202 includes a hydraulic starter motor 250 arranged to receive a portion of the oil discharged from the hydraulic accumulator 240 and direct the oil to the hydraulic starter motor 250 to start the engine by being driven by the oil.

Within the second flow path first (starter) branch 202 is also included a hydraulic starter solenoid valve 244 which is configured to receive an input signal from control module 6. In response to an engine start command received by the control module 6, the control module 6 sends an output signal to the hydraulic starter solenoid valve 244 to open the hydraulic starter solenoid valve 244 such that oil under the pressure of the accumulator (i.e. preferably 1,000-5,000 psi.) may flow to the hydraulic starter motor 250, causing the hydraulic starter motor 250 to rotate. Once the oil flows through the hydraulic starter motor 250, the oil may flow, particularly by gravity, back to the sump 20.

The control module 6 may be programmed to send a signal to open the hydraulic starter solenoid valve 244 for a time period determined by control module 6 for the engine 2 to achieve a suitable RPM to start, during or upon which time fuel and spark (in the case of a spark ignition engine) may be delivered to the cylinders. Once the engine 2 starts to rotate under its own power, and begins to rotate at a rotation speed faster than the hydraulic starter motor 250, the hydraulic starter motor 250 may be disengaged from engagement with the crankshaft 12 by an overrunning clutch 260. In order to ensure a constant volume of oil flow to the hydraulic starter motor 250 during starting, the second flow path first (starter) branch 202 may further include a flow control valve 248 downstream of the hydraulic starter solenoid valve 244.

Second flow path second (pre-lubrication) branch 204 is arranged to receive a portion of the oil discharged from the hydraulic accumulator 240 and direct the oil to lubricate the engine 2 during at least one of a pre-starting operation and a starting operation of the engine 2 with the oil. Second flow path second (pre-lubrication) branch 204 includes a pre-lubrication solenoid valve 270 which is configured to receive an input signal from control module 6. In response to an engine start command received by the control module 6, the control module 6 sends an output signal to the pre-lubrication solenoid valve 270 to open the pre-lubrication solenoid valve 270 such that oil under the pressure of the accumulator (i.e. preferably 1,000-5,000 psi.) may flow to oil pressure regulator 280, where the pressure of the oil is reduced in a range of the pressure of the oil pump, i.e. 30-60 psi. After flowing through the oil pressure regulator 280, the oil may then flow within the oil gallery 4 of the engine 2 to oil outlet (distribution) ports 40 (as shown in FIG. 1) which provide oil to the crankshaft 12, or other engine components 14, which may include bearings, cylinder walls, pistons, rings and valve train. Thereafter, the oil handled by the second flow path second (pre-lubrication) branch 204 may flow, particularly by gravity, back to the sump 20.

In order to pre-lubricate the engine components 14 before starting the engine 2, in response to an engine start command received by the control module 6, the control module 6 may send the output signal to the pre-lubrication solenoid valve 270 to open the pre-lubrication solenoid valve 270 before sending the output signal to the to the hydraulic starter solenoid valve 244 to open the hydraulic starter solenoid valve 244. For example, the control module 6 may open the pre-lubrication solenoid valve 270 for 0.1-3.0 seconds before the hydraulic starter solenoid valve 244 is opened and the hydraulic starter 250 is engaged to better ensure that the engine 2 is pre-lubricated before starting, which may be referred to a pre-starting lubrication or pre-oiling.

Thus, when the engine 2 is stopped, high pressure oil is stored in the hydraulic accumulator 240. When the engine is commanded to start again, the second flow path second (pre-lubrication) branch 204 is activated by activating its solenoid valve 270, and the second flow path first (starter) branch 202 is activated by activating its solenoid valve 244. The timing and duration of these two events will depend upon the engine design and lubrication requirements to optimize pre-lubrication and starting reliability.

As set forth above, the second flow path second (pre-lubrication) branch 204 includes a pressure regulator 280 to reduce the high pressure flow from the accumulator 240 down to a pressure suitable for engine operation, while the second flow path first (starter) branch 202 includes a flow control valve 248 to limit the speed at which the starter motor 250 will rotate, which will be nominally around engine idle speed. As the engine starts and runs on its own, the hydraulic starter solenoid valve 244 is deactivated, blocking flow to the starter motor 250 and stopping its rotation. An overrunning clutch 260, or other device to mechanically disengage the hydraulic starter from the engine 2, will allow the engine 2 to run with no drag torque from the starter motor 250.

Referring now to FIG. 3, there is shown a schematic of an internal combustion engine oil utilization system according to a second preferred embodiment of the present disclosure. In contrast to the embodiment of FIG. 2, among other things, this preferred embodiment includes two oil pumps 16 and 18, while hydraulic pressure intensifier 210 has been eliminated.

After entering pick-up conduit 24, the engine oil circulation loop 10 segments into a first flow path 100 and a second flow path 200, as indicated by the corresponding arrows. While the drawing only shows one pick-up conduit 24, it should be understood that the first flow path 100 and second flow path 200 may have separate pick-up conduits 24.

Similar to the prior embodiment, the first flow path 100 is arranged to receive at least a portion of the oil discharged from the oil pump 16 and to direct the oil to lubricate the internal components 14 of the engine 2 including the crankshaft 12, during running operation of the engine 2. As with the previous embodiment, the oil flows through first (main) oil pump 16, oil filter 30 and a one-way check valve 110. As such, after passing through a one-way check valve 110, oil in the first flow path 100 flows within oil gallery 4 of the engine 2 to oil outlet (distribution) ports 40 (as shown in FIG. 1) which provide oil to the crankshaft 12, or other engine components 14, which may include bearings, cylinder wall, piston, rings and valve train. Thereafter, the oil handled by the first flow path 100 may flow, particularly by gravity, back to the sump 20.

The second flow path 200 is arranged to receive at least a portion of the oil discharged from a second (auxiliary) oil pump 18 and direct the oil (1) to lubricate the engine 2 during running operation of the engine 2, and/or (2) to start the engine 2 and/or to lubricate the engine 2 during at least one of a pre-starting operation and a starting operation of the engine 2.

The second flow path 200 includes a diverter valve 90, which is selectively disposable in a first arrangement mode 92 and a second arrangement mode 94. As shown, in the first arrangement mode 92 of the diverter valve 90, the oil received by the second flow path 200 is directed to lubricate the engine 2 during running operation of the engine 2. More particularly, the second flow path 200 merges with the first flow path 100 downstream of the first oil pump 16 and upstream of the oil filter 30. In the event too much oil from the first oil pump 16 and the second oil pump 18 is directed to lubricate the engine 2 during operation of the engine 2, a pressure relief valve 80 downstream of the first oil pump 16 and upstream of the oil filter 30 may be opened to return excess oil to the sump 20.

Diverter valve 90 is configured to toggle (shuttle) between the first arrangement mode 92 and the second arrangement mode 94 when oil pressure of the oil in the first flow path 100 exceeds a predetermined minimum oil pressure, such as exceeding 60 psi. In the second arrangement mode 94 of the diverter valve 90, the oil received by the second flow path 200 is directed to start the engine 2 and/or to lubricate the engine 2 during at least one of a pre-starting operation and a starting operation of the engine 2.

Downstream of the diverter valve 90, the second flow path includes a check valve 98, a high pressure oil filter 32 and hydraulic accumulator 240 arranged to receive, store and discharge oil pressurized and discharged by the second oil pump 18. Similar to first oil pump 16, second oil pump 18 may be a positive (fixed) displacement pump. As such, the second oil pump 18 will continue to build pressure on the oil within the second flow path 200 after the hydraulic accumulator 240 is filled. Once the hydraulic accumulator 240 is filled and the oil is at a pressure in a range of 1,000-5,000 psi., and more particularly in a range of 2,000-3,000 psi., diverter valve 90 may be opened to return excess oil to the sump 20 or a high-pressure unloading valve 96 may be opened to direct excess oil to lubricate the engine 2 during running operation of the engine 2.

Downstream of the hydraulic accumulator 240, the second flow path 200 comprises a second flow path first (starter) branch 202 and a second flow path second (pre-lubrication) branch 204, and the system operates in a similar manner to the first embodiment.

The second oil pump 18, which may be of a smaller displacement than the first oil pump 16 may operate under three different conditions. When oil pressure is relatively low (e.g. less than 60 psi.), such as during starting and at low idle speeds, the diverter valve 90 may be in first arrangement mode 92. As such, the oil flow from the second oil pump 18 flows through a diverter valve 90 and joins the oil flow coming from the first oil pump 16.

When the pressure in the first flow path 100 exceeds a predetermined minimum oil pressure, such as exceeding 60 psi., the pressure activates diverter valve 90 to second arrangement mode 94 and redirect the oil flow from the second oil pump 18 to the hydraulic accumulator 240. The oil flow passes through a one-way (ball) check valve 98 and enters the hydraulic accumulator 240, increasing its pressure.

When the pressure in the hydraulic accumulator 240 reaches its maximum predetermined level, high pressure unloading valve 96 is actuated by the accumulator pressure to direct the oil flow from the second oil pump 18 to join the oil flow from the first oil pump 16 at the pressure level of the first flow path 100. If the pressure level of the first flow path 100 exceeds the minimum predetermined level, excess flow from first oil pump 16 and the second oil pump 18 may pass through the relief valve back 80 to the sump 20.

The second oil pump 18 may be smaller than the first oil pump 16 and, as with the first oil pump 16, may be selected from a variety of pump types that produce a positive displacement including the various gear pump types or reciprocating piston types. The first oil pump 16 may be reduced in displacement so that the combined displacement of the first oil pump 16 and the second oil pump 18 would provide the equivalent flow of a conventional engine oil pump.

In certain embodiments the hydraulic starter motor 250 may be part of a starter motor assembly which operates both hydraulically and electrically with an integrated electrical motor. Electric starting may be required in situations of repeated starting and stopping of the engine 2 in a relatively short period of time during which the accumulator 240 may not accumulate enough oil to start the engine 2.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

LIST OF REFERENCE CHARACTERS

2 internal combustion engine
4 engine oil gallery
6 engine control module
10 engine oil circulation loop
12 internal combustion engine crankshaft
14 engine components
16 oil pump
18 oil pump
20 engine sump
22 oil strainer
24 pick-up conduit
30 oil filter
32 oil filter
40 oil outlet (distribution) ports
50 relief valve
60 diverter valve
70 pressure relief valve
80 pressure relief valve
90 diverter valve
92 diverter valve first arrangement mode
94 diverter valve second arrangement mode
96 diverter valve
98 one-way check valve
100 first flow path
102 first flow path first (starter) branch
104 first flow path second branch
110 one-way check valve
200 second flow path
202 second flow path first (starter) branch
204 second flow path second (pre-lubrication) branch
210 hydraulic pressure intensifier
212 piston, hydraulic pressure intensifier
213 small end of piston
214 one-way check valve
216 one-way check valve
240 hydraulic accumulator
244 hydraulic starter solenoid valve
248 flow control valve
250 hydraulic starter motor
260 overrunning clutch
270 pre-lubrication solenoid valve
280 oil pressure regulator

What is claimed is:

1. An internal combustion engine oil utilization system, the system comprising:

one or more oil pumps to receive and discharge engine oil;

an engine oil circulation loop comprising a first flow path and a second flow path;

the first flow path to receive at least a portion of the oil discharged from the one or more oil pumps and utilize the oil to lubricate the engine during running operation of the engine; and the second flow path to receive at least a portion of the oil discharged from the one or more oil pumps and accumulate the oil to start the engine and/or to lubricate the engine during at least one of a pre-starting operation and a starting operation of the engine.

2. The system of claim 1 wherein:

the second flow path includes a hydraulic accumulator.

3. The system of claim 2 wherein:

the second flow path includes a hydraulic starter motor, and the hydraulic starter motor is in fluid communication with the hydraulic accumulator to receive oil stored in the hydraulic accumulator to start the engine.

4. The system of claim 3 wherein:

the second flow path includes a solenoid valve located upstream of the hydraulic starter motor; and the solenoid valve is configured to control flow of the oil from the hydraulic accumulator to the hydraulic starter motor.

5. The system of claim 3 wherein:

the hydraulic starter motor is mechanically coupled to a clutch to engage to a crankshaft of the engine and disengage from the crankshaft of the engine.

6. The system of claim 3 wherein:

the hydraulic starter motor is integrated with an electric starter motor of an electric starter motor assembly.

7. The system of claim 2 wherein:

the second flow path includes an oil gallery of the engine, and the oil gallery is in fluid communication with the hydraulic accumulator to receive oil stored in the hydraulic accumulator to lubricate the engine during at least one of a pre-starting operation and a starting operation of the engine.

8. The system of claim 7 wherein:

the second flow path includes a solenoid valve located upstream of the oil gallery; and the solenoid valve is configured to control flow of the oil from the hydraulic accumulator to the oil gallery.

9. The system of claim 7 wherein:

the second flow path includes a pressure regulator; and the pressure regulator is in fluid communication with the hydraulic accumulator to receive oil stored in the hydraulic accumulator; and the pressure regulator is configured to reduce a pressure of the oil received from the hydraulic accumulator.

10. The system of claim 2 wherein:

the second flow path includes a hydraulic pressure intensifier upstream of the hydraulic accumulator, and the hydraulic pressure intensifier is in fluid communication with the hydraulic accumulator to provide oil to the hydraulic accumulator.

11. The system of claim 10 wherein:

the hydraulic pressure intensifier is arranged to pressurize the oil received by the second flow path to at least 1,000 psi.

12. The system of claim 10 wherein:

the hydraulic pressure intensifier is arranged to pressurize the oil received by the second flow path to a range of 1,000-5,000 psi.

13. The system of claim 10 wherein:

the second flow path includes a pressure relief valve upstream of the hydraulic pressure intensifier.

14. The system of claim 1 wherein:

the one or more oil pumps comprise a first oil pump; and the first flow path to receive at least a portion of the oil discharged from the first oil pump and utilize the oil to lubricate the engine during running operation of the engine; and the second flow path to receive at least a portion of the oil discharged from the first oil pump and accumulate the oil to start the engine and/or to lubricate the engine during at least one of a pre-starting operation and a starting operation of the engine.

15. The system of claim 14 wherein:

the engine oil circulation loop comprises a diverter valve configured to divert oil discharged from the first oil pump from the first flow path to the second flow path.

16. The system of claim 15 wherein:

the diverter valve is configured to open and divert oil to the second flow path when oil pressure in the first flow path equals a predetermined value.

17. The system of claim 1 wherein:

the one or more oil pumps to receive and discharge engine oil comprise at least a first oil pump and a second oil pump.

18. The system of claim 17 wherein:

the first flow path to receive at least a portion of the oil discharged from the first oil pump and utilize the oil to lubricate the engine during running operation of the engine; and the second flow path to receive at least a portion of the oil discharged from the second oil pump and accumulate the oil to start the engine and/or to lubricate the engine during at least one of a pre-starting operation and a starting operation of the engine.

19. The system of claim 18 wherein:

the second flow path is selectively disposable in a first arrangement mode or a second arrangement mode;

wherein, in the first mode, the second flow path to receive at least a portion of the oil discharged from the second oil pump and utilize the oil to lubricate the engine during running operation of the engine; and wherein, in the second mode, the second flow path to receive at least a portion of the oil discharged from the second oil pump and accumulate the oil to start the engine and/or to lubricate the engine during at least one of a pre-starting operation and a starting operation of the engine.

20. The system of claim 19 wherein:

the second flow path is selectively disposable in the first arrangement mode or the second arrangement mode with a diverter valve.

21. The system of claim 20 wherein:

the diverter valve is configured to operate in the first arrangement mode when oil pressure in the first flow path is below a predetermined value, and configured to operate in the second arrangement mode when the oil pressure in the first flow path equals or exceeds the predetermined value.

22. A method of engine oil utilization for an internal combustion engine, the method comprising:

providing one or more oil pumps to receive and discharge oil;

providing an engine oil circulation loop comprising a first flow path and a second flow path;

the first flow path to receive at least a portion of the oil discharged from the one or more oil pumps and utilize the oil to lubricate the engine during running operation of the engine; and the second flow path to receive at least a portion of the oil discharged from the one or more oil pumps and accumulate the oil to start the engine and/or to lubricate the engine during at least one of a pre-starting operation and a starting operation of the engine, the second flow path including a hydraulic accumulator;

starting the engine with a hydraulic starter motor, wherein the hydraulic oil pump is driven with engine oil stored in the hydraulic accumulator of the second flow path;

operating the engine;

while operating the engine, providing oil to the first flow path from the one or more oil pumps and lubricating the engine with at least a portion of the oil provided in the first flow path; and while operating the engine, providing oil in the second flow path from the one or more oil pumps and storing at least a portion of the oil in the hydraulic accumulator.

* * * * *